US006438868B1

(12) United States Patent
Fini

(10) Patent No.: US 6,438,868 B1
(45) Date of Patent: Aug. 27, 2002

(54) METHOD FOR MAKING SHOES AND THE SHOES OBTAINED USING SAID METHOD

(75) Inventor: Carlo Fini, Bologna (IT)

(73) Assignee: A. Testoni S.p.A., Bologna (IT)

( * ) Notice: Subject to any disclaimer, the term of this patent is extended or adjusted under 35 U.S.C. 154(b) by 0 days.

(21) Appl. No.: 09/598,179

(22) Filed: Jun. 21, 2000

(30) Foreign Application Priority Data

Nov. 23, 1999 (IT) ..... BO99A0631

(51) Int. Cl.[7] ..... A43B 13/28; A43B 9/10

(52) U.S. Cl. ..... 36/12; 36/16; 36/88; 36/22 R; 12/146 B; 12/142 T

(58) Field of Search ..... 36/12, 16, 22 R, 36/31, 88, 93, 154, 11; 12/146 B, 146 C, 142 T, 142 RS

(56) References Cited

U.S. PATENT DOCUMENTS

| | | | | | |
|---|---|---|---|---|---|
| 197,636 | A | * | 11/1877 | Nummel et al. | |
| 1,575,813 | A | * | 3/1926 | Burke et al. | |
| 1,972,339 | A | * | 9/1934 | Grosz | 36/16 |
| 2,054,188 | A | * | 9/1936 | Bates | |
| 2,719,367 | A | * | 10/1955 | Bergmans | 36/16 |
| 2,958,965 | A | * | 11/1960 | Scala | |
| 3,640,003 | A | * | 2/1972 | Anderson | |
| 3,694,940 | A | * | 10/1972 | Stohr | 36/10 |
| 4,250,638 | A | * | 2/1981 | Linnemann | 36/16 |
| 4,308,671 | A | * | 1/1982 | Bretschneider | 36/16 |
| 4,858,340 | A | * | 8/1989 | Pasternak | 36/88 |
| 4,864,740 | A | * | 9/1989 | Oakley | 36/44 |
| 5,714,098 | A | * | 2/1998 | Potter | 12/142 R |
| 5,733,647 | A | * | 3/1998 | Moore, III et al. | 36/93 |
| 5,885,622 | A | | 3/1999 | Daley | |

FOREIGN PATENT DOCUMENTS

| | | |
|---|---|---|
| DE | 26 39 482 A1 | 3/1978 |
| DE | 36 37 030 | 7/1987 |
| FR | 2 755 350 A1 | 5/1998 |
| FR | 2 772 563 | 6/1999 |
| GB | 2 158 692 A | 11/1985 |
| GB | 2 317 811 B | 4/1998 |
| JP | 01284202 | 11/1989 |

OTHER PUBLICATIONS

EP 00 83 0440.4 Search Report dated Feb. 27, 2002.

* cited by examiner

*Primary Examiner*—M. D. Patterson
(74) *Attorney, Agent, or Firm*—Fay, Sharpe, Fagan, Minnich & McKee, LLP

(57) ABSTRACT

A method for making shoes comprises the stages of molding a base of the shoe according to a preset curve, folding the edges of the base outwards, folding the flaps of an upper outwards and of joining the upper to the base at the outer edge of the base. The method may also comprise stages of applying a thermoformable element on a first surface of the base, at least at the outer edge of the base and of applying a sole element, on at least a portion of a second surface of the base. A shoe obtained in this way, therefore, comprises a base, molded according to a preset curve and an upper attached to the base at the outer edge of the base by joining the flaps of the upper and the edges of the base which are folded outwards.

16 Claims, 5 Drawing Sheets

METHOD FOR MAKING SHOES AND THE SHOES OBTAINED USING SAID METHOD

BACKGROUND OF THE INVENTION

The present invention relates to a method for making shoes and the shoes obtained using this method.

Conventional methods for making shoes (this term indicating the classic type of shoe preferably made of leather and consisting of a base, an upper and a sole) include application of a sole on a base of the shoe and application of an upper which is normally stitched and/or glued to the outer edge of the base.

In accordance with this known method, a flat base is used, normally of the same size as the sole of the foot, to which an upper is then applied, shaped according to the style of shoe to be obtained.

The upper may be reinforced at the portion which is joined to the base, so as to follow the shape of the foot.

The flaps of the upper are normally folded inwards then applied, for example by stitching, to the base of the shoe, at the zone where the sole is attached.

The shoe obtained using the above-mentioned method, therefore, consists of a base, with the sole applied on one side and the upper on the other. The upper is shaped each time according to the style of shoe, as indicated above.

The conventional method therefore requires various particularly laborious processing stages which increase production costs.

Application of the upper to a flat base which is the same size as the sole of the foot necessitates internal stitching in the upper, which is difficult and cannot always be effected in a fully automated fashion. Basically, the flaps of the upper cannot be folded outwards and then applied to the base, since the sole would then have to be modified in order to obtain a strong, comfortable shoe.

Moreover, the upper requires a series of processing operations not only to define its shape, but also to create a special configuration, which may even be reinforced, which can follow the shape of the foot and, at the same time, defines the style of shoe.

In addition, for each style of shoe, the configuration is standard and it is difficult to adapt it to the shape of the foot in a limited period. The shoe must be worn for a lengthy period before it moulds to the shape of the foot and this breaking-in period normally coincides with inevitable wear on the shoe.

The aim of the present invention is, therefore, to overcome the above-mentioned disadvantages by providing a method for making shoes in which any type of upper is easily applied to the base which is made in the meantime using extremely simple processing methods which can be standardized, that is to say automated, for any final style and shape of shoe to be made.

Another aim of the present invention is to provide a method which allows the production of a shoe which rapidly moulds to the shape of the wearer's foot.

A further aim of the present invention is to eliminate both complex processing on uppers without reducing the strength and comfort of the shoe, and laborious operations for application of the upper on the base of the shoe.

SUMMARY OF THE INVENTION

These aims and others which are described in more detail in the description below are achieved in accordance with the present invention by a method for making shoes, characterized in that it comprises stages of molding a base of the shoe according to a preset curve, applying a thermoformable element on a first surface of said base, at least at the outer edge of the base; applying a sole, at least on a portion of a second surface of the base; and joining an upper to the base at the outer edge of the base.

The present invention also relates to a shoe comprising a base, a sole applied to the base and an upper joined to the base at the outer edge of the base, characterized in that the base is molded according to a preset curve and has a thermoformable element, at least at its outer edge.

BRIEF DESCRIPTION OF THE DRAWINGS

Further characteristics and advantages of the present invention are more clearly illustrated in the detailed description which follows, with reference to the accompanying drawings, which illustrate a preferred embodiment without limiting the scope of application, and in which.

DESCRIPTION OF THE PREFERRED EMBODIMENTS

Figure 3:
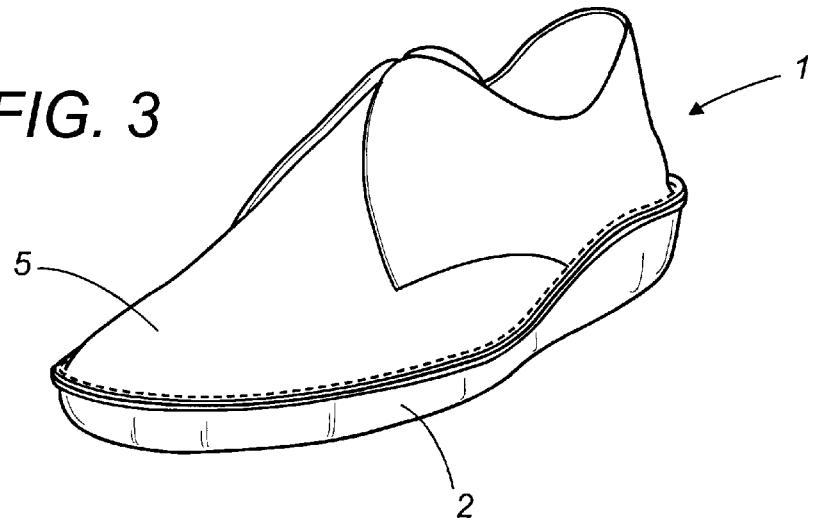
FIG. 3 is a perspective view of a third stage of the method according to the present invention.
Figure 12:
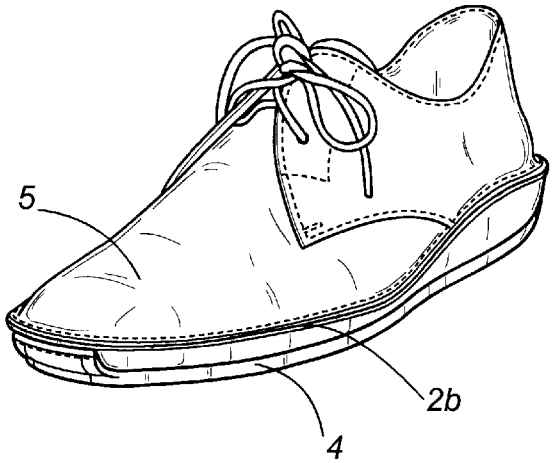
FIG. 12 is a perspective view of the embodiment illustrated in FIG. 11.
Figure 13:
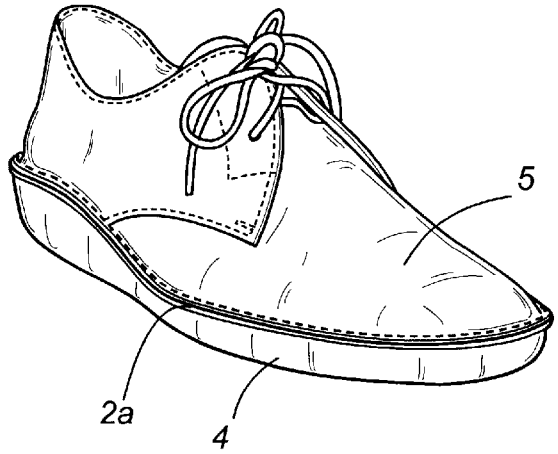
FIG. 13 is a perspective view of a second embodiment of the shoe which can be obtained using the method disclosed.

With reference to the accompanying drawings and in particular FIGS. 3, 12 and 13, the numeral 1 indicates a shoe which can be obtained using the method which is the subject matter of the present invention.

Figure 1:
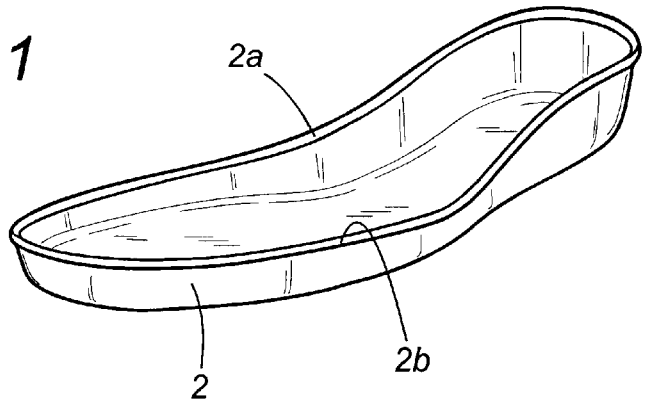
FIG. 1 is a perspective view of a first stage of the method for making shoes in accordance with the present invention.

In particular, the method disclosed comprises a first stage, illustrated in FIG. 1, which consists in forming a hull shaped base 2 of the shoe 1 according to a preset curve, with a molded configuration which is concave in an upwards direction. The initially flat base 2 is formed in such a way that it has an undulating profile with two hollows at the sole of the foot and the heel, with the edges 2*a*, 2*b* folded outwards.

Figure 2:
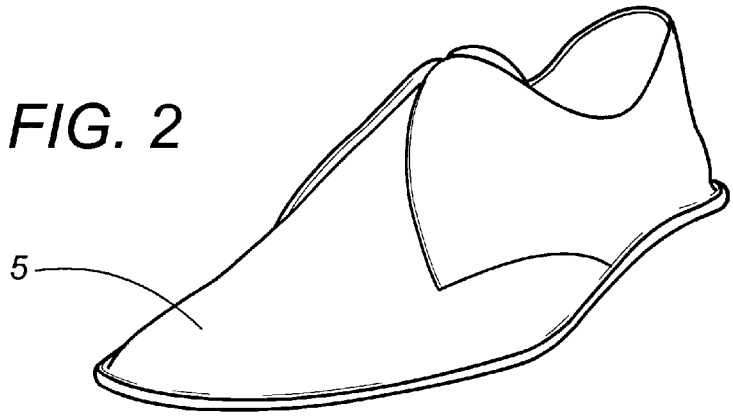
FIG. 2 is a perspective view of a second stage of the method according to the present invention.

The method comprises a subsequent stage, illustrated in FIG. 2, in which the flaps of an upper are folded outwards, so that they can then be joined to the edges 2*a*, 2*b* along the entire outer edge of the base 2 (FIG. 3), overlapping them to form lips which are stitched together, for example with extremely simple outer-to-outer through-stitches, thus avoiding laborious internal folding and simplifying application of the upper, all thanks to the creation of a molded base of the type described above.

Figure 4:
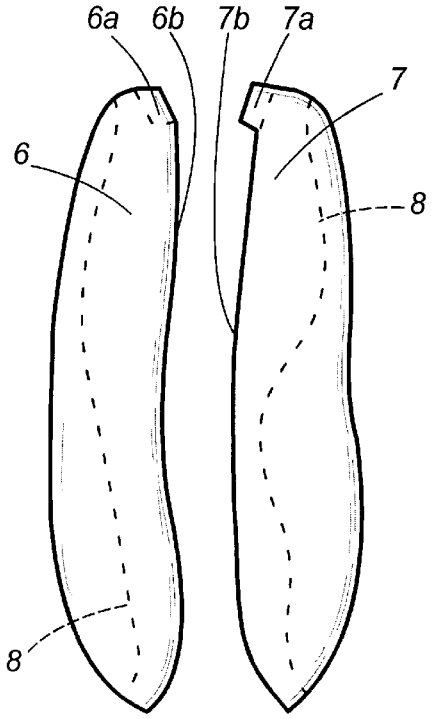
FIGS. 4, 5 and 6 are top plan views of further stages of the method according to the present invention.
Figure 5:
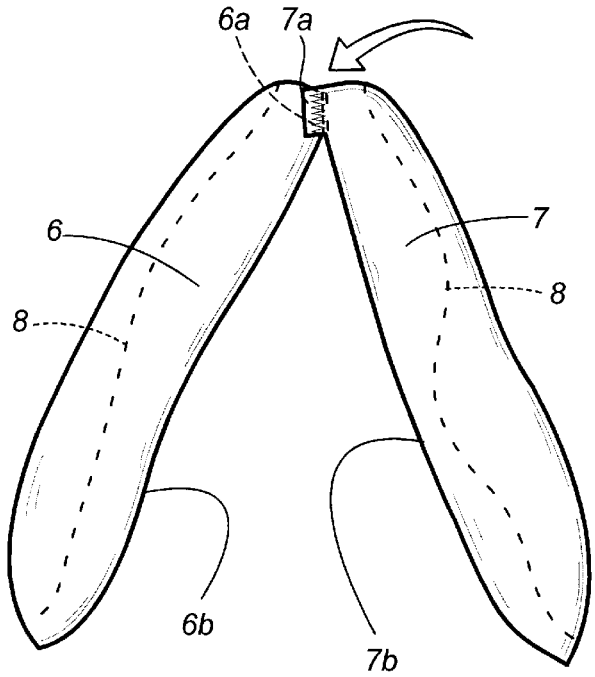

In a preferred embodiment, illustrated in FIG. 4, the preset curve, that is to say, the concave molded configuration, is obtained by putting two initially flat pre-shaped portions 6, 7 which form the base 2 of the shoe 1 together and joining them, for example by stitching them to one another. These portion 6, 7 are, for example, made of two flat strips of leather, suitably shaped and having lines 8 indicating the ideal sole of the foot (see dashed line in FIGS. 4 to 6) on at least one surface.

These two portions may be made of various materials, for example hide, leather, crocodile, plastic or rubber, partly depending on the type of shoe to be made.

Figure 7:
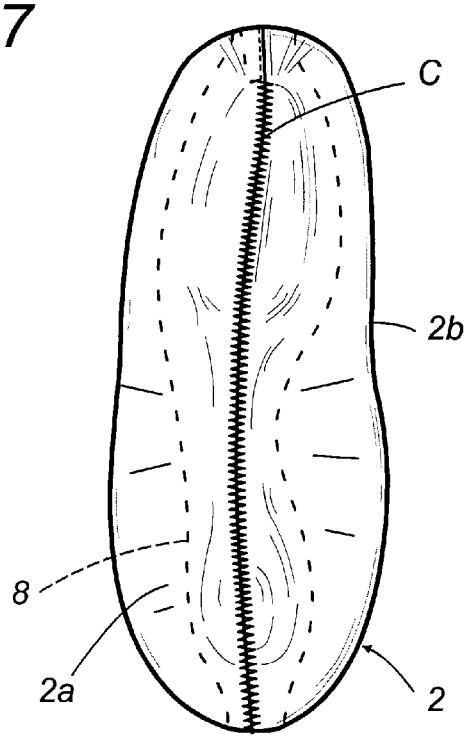
FIGS. 7 and 8 are respectively a bottom plan view and a top plan view of a subsequent stage of the method according to the present invention.

The two portions 6, 7 are joined by first overlapping one end 6*a* of the portion 6 and a corresponding end 7*a* of the portion 7 (see FIG. 5), then bringing the two portions 6, 7 together and stitching the two internal flaps 6*b*, 7*b* along a stitching line labeled C (see FIG. 7).

Given the initial configuration of the two portions 6, 7, following stitching C, a base 2 is obtained with a molded configuration with undulating profile, in which the edges 2*a*, 2*b* are slightly raised relative to the central part.

Before the two portions 6, 7 are stitched together along C, at least one thermoformable element 3 (see FIG. 6) is applied, for example by gluing, at the outer edge and on the upper surface of the base 2, which will later form the inside of the shoe.

Figure 6:
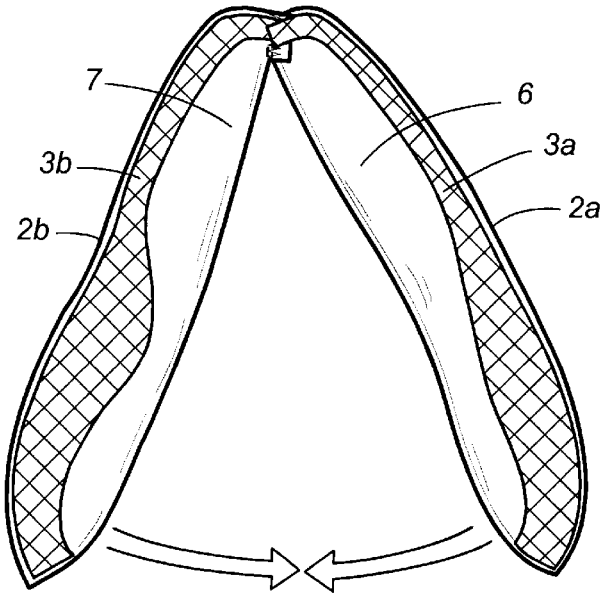

FIG. 6 also illustrates how, if the base 2 is made by bringing together two portions, two thermoformable elements 3*a*, 3*b* can preferably be used.

The thermoformable element 3 consists of one or more strips of thermoplastic material, each of which is shaped in such a way as to delimit an ideal foot shape on the base 2 at the only portion which will not be in contact with the sole.

Figure 8:
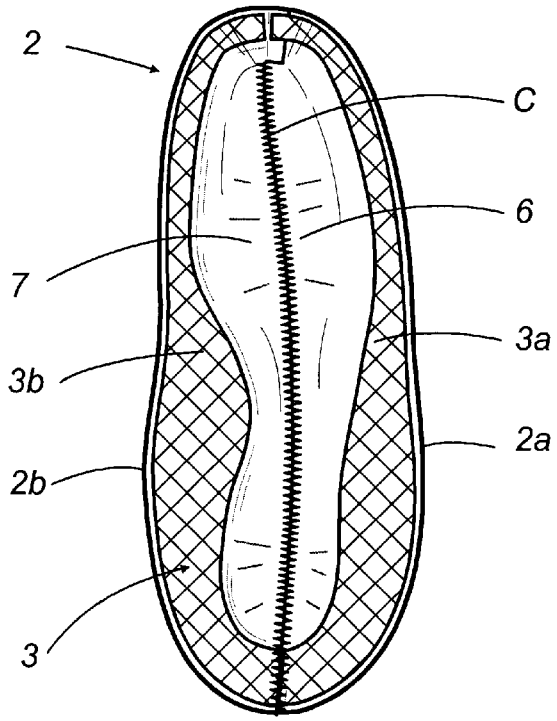

This produces an undulated base 2, with raised edges 2*a* and 2*b* (see FIGS. 7, 8 and 10) in which is applied the thermoformable material, which can easily be molded to follow the shape of the lower sides of the foot.

Figure 10:
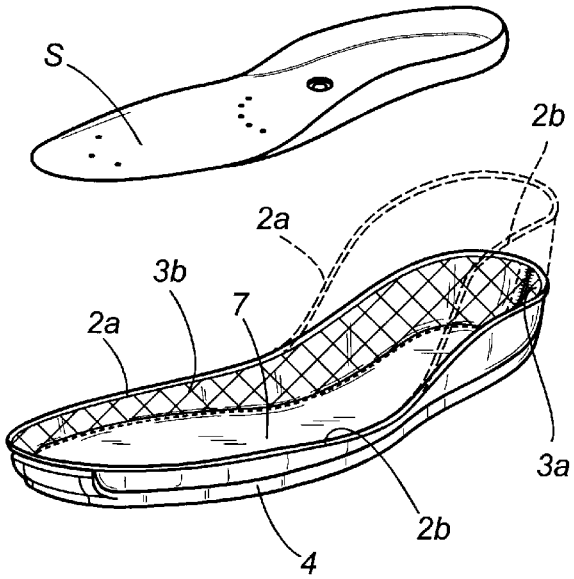
Figure 11:
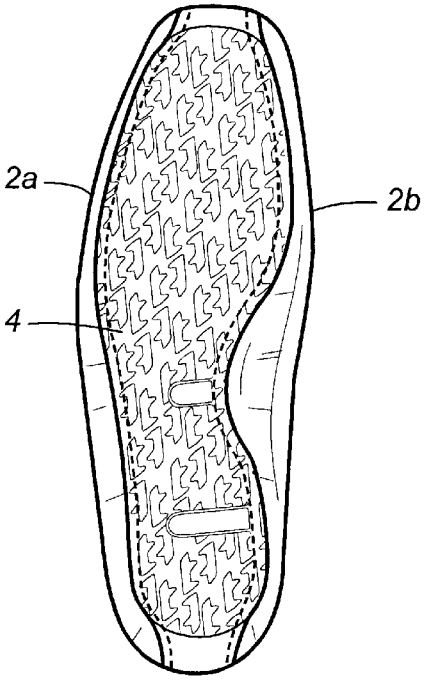
FIG. 11 is a bottom plan view of a first embodiment of the shoe which can be obtained using the method disclosed.

The method disclosed then envisages application of a sole 4 on at least one portion of the lower surface of the base 2, preferably not in contact with the thermoformable elements 3*a* and 3*b* (see FIGS. 10 and 11).

The sole 4 may be applied in accordance with various embodiments.

In a first embodiment, illustrated in FIGS. 11 and 12, the sole 4 is applied to a portion of the base 2 substantially delimited by the inner profile of the thermoformable element 3.

The sole is placed over the lower surface of the base 2, on the surface delimited by the indication lines 8 and is then stitched to the base 2.

This configuration means that the shoe can be made lighter, which is advantageous for "open" style, such as sandals and summer footwear.

In a second embodiment, illustrated in FIG. 13, the sole is applied to the entire base 2, as far as the flaps 2*a*, 2*b*, which are joined to an upper 5.

This embodiment is particularly advantageous to further reinforce or protect the lower part of the shoe, typically for winter footwear.

After application of the upper 5 there is a stage of thermoforming the base 2, in order to consolidate the shape to be given to the base (also illustrated in FIG. 10, for a clearer example of the shape).

This thermoforming stage may be effected by inserting a mould which can be heated (not illustrated here) in the shoe 1 then, when the thermoforming is complete, rapidly cooling it. Alternatively, thermoforming can be achieved by inserting a normal mould in the shoe 1 and placing the shoe and mould in a special high-humidity oven. After a preset time, the shoe 1 is taken out of the oven and rapidly cooled to obtain the desired molding.

To summarize, in both embodiments, a lower part of the shoe is obtained, described as the molded configuration, the lower section of which has a sole which rests on the floor and the upper part (corresponding to the inside of the shoe) being delimited at its edge by a portion or edge of the molded configuration which comprises the thermoformable element. All of this improves the strength and adaptability to the shape of the foot required and the molded configuration only requires application of an upper shaped appropriately for the style selected. This may be of the lace-up type, as illustrated by way of example in the accompanying drawings, the moccasin type, with an open heel (Chanel style), or may simply have a strip of upper which defines a sandal for summer use, or with crossed strips or, finally, with the upper at various heights to create a high-laced shoe or boot. This is all achieved using the same lower molded configuration made in accordance with the simplified method described above.

The validity of the solution disclosed is confirmed by the fact that, for shoe styles with a high heel or a difference between the thickness of the rear and front parts, it is possible to use portions 6 and 7 with a larger side projection so that, when the molded configuration is complete, they are higher than those illustrated (see dashed line in FIG. 10) accommodating a platform heel to strengthen and raise the rear zone.

In another embodiment of the shoe, illustrated in FIG. 3, the sole 4 consists of the lower surface of the base 2 made, for example, of rubber, formed according to a preset molded curve and with the edges 2*a*, 2*b* folded outwards.

To create this embodiment of the shoe, the stage of folding the edges 2*a*, 2*b* of the base is carried out simultaneously with the stage of forming the base 2, for example by means of an injection process.

Figure 14:
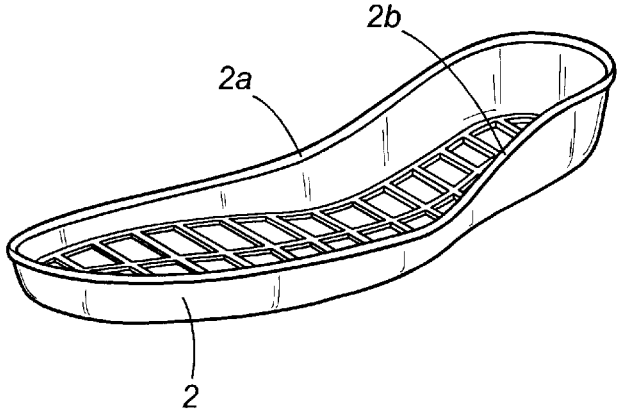
FIG. 14 is a perspective view of another embodiment of the shoe.

In this embodiment, in order make the base 2 of the shoe "lighter" and so more flexible, there is a plurality of holes 10 distributed over the first surface of the base 2, in a mesh configuration in FIG. 14.

Figure 9:
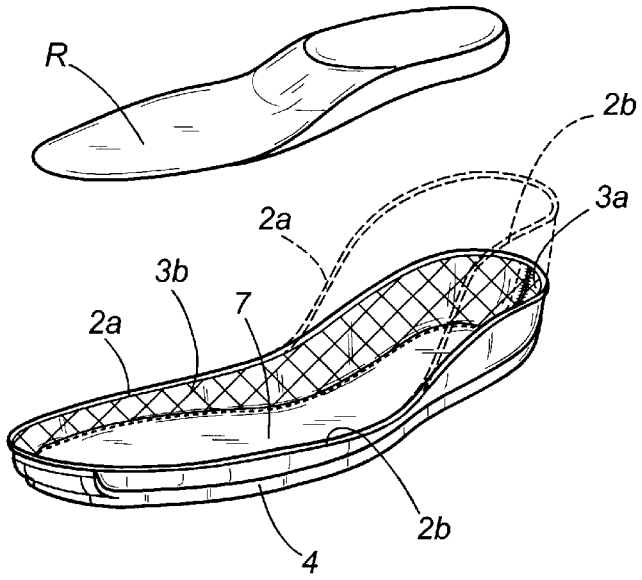
FIGS. 9 and 10 are perspective views of further stages of the method according to the present invention.

As illustrated in FIG. 9, an insert R may be put in the shoe made according to the present invention, positioned on the first surface of the base 2, so as to adapt the shoe to the size of the wearer's foot. The insert R consists of a flat strip having a bottom surface butted on the first surface of the base 2.

In addition, when the embodiment of the shoe illustrated above is shaped and finished, a thermoformable inner sole is inserted in the shoe to further improve its adaptability to the wearer's foot. This inner sole, labeled S in FIG. 10, is an integral part of the shoe made in accordance with the method disclosed, since it allows on one hand an even distribution and diffusion of the wearer's weight in the shoe space, with the reaction given by the molded configuration, and on the other hand allows adaptability to the shape of the foot, irrespective of the shape of the molded configuration itself. It is thanks to this combination of the molded configuration and inner sole that a comfortable, strong shoe is obtained, which can be adapted to all requirements and is durable.

The method disclosed, therefore, allows a strong, comfortable shoe to be obtained, whilst limiting difficult processing.

In accordance with the method described, no special work is required on the upper and complex operations for application of the upper on the base of the shoe are not necessary.

The adaptability of the shoe to the shape of the wearer's foot is obtained by molding the thermoformable element and applying said thermoformable element to the base.

The base is first molded so that it follows the natural shape of the foot then, by thermoforming, it is shaped so that it follows the ideal shape of the foot.

Thanks to the presence of the thermoformable element, the shoe can then easily and rapidly adapt to the actual shape of the wearer's foot during use.

Moreover, the stages described are always the same for any style of shoe, which is then made different following application of the upper.

In addition, the fact that the base extends beyond the ideal sole of the foot allows external stitching of the flaps on the upper to the edges of the base. This stitching is much easier than that commonly used with internal folding of the flaps on the uppers over the base of the shoe.

The present method, therefore, significantly simplifies shoe making and reduces the time required.

The shoe 1 which can be obtained using the method disclosed therefore has a base 2 and an upper 5, the shape varying according to the style, joined to the flaps 2*a*, 2*b* of the base 2 by external stitching.

The shoe 1 may have an outer sole 4 on the lower surface of the base 2 and a thermoformable element 3 inside the shoe.

In an alternative embodiment, the sole 4 may consist of the lower surface of the base 2.

The invention described can be subject to modifications and variations without thereby departing from the scope of the inventive concept. Moreover, all the details of the invention may be substituted by technically equivalent elements.

What is claimed is:

1. A method for making shoes comprising the steps of:

a) molding a hull shaped base of the shoe having edges which present a preset curve, said step of molding the hull shaped base comprising the sub-step of joining at least two pre-shaped flat portions along a predetermined stitching line;

b) folding the edges of the base outwards;

c) folding flaps of an upper of the shoe outwards; and, d) joining the folded edges of the base with the folded flaps of the upper.

2. The method according to claim 1, wherein the step of folding the edges of the base outwards is simultaneous to the step of molding the base.

3. The method according to claim 1, wherein said step of molding the hull shaped base comprises defining the base to have an inner concave surface, and wherein said method further comprises:

applying a thermoformable element on the inner concave surface of the hull shaped base.

4. The method according to claim 3, further comprising a thermoforming stage to consolidate the shape to be given to lab thermoformable element.

5. The method according to claim 4, wherein the thermoforming stage comprises heating the shoe using a heated mold which acts inside the shoe for a preset time, followed by rapid cooling of the shoe.

6. The method according to claim 4, wherein the thermoforming stage comprises:

inserting a mold in the shoe; and, inserting the shoe in a high-humidity oven for a preset time in order to heat the shoe, followed by rapid cooling of the shoe.

7. The method according to claim 1, wherein said step of molding the hull shaped base comprises defining the base to have an outer convex surface, and wherein said method further comprises:

applying a sole element to at least on a portion of the outer convex surface of the hull shaped base.

8. The method according to claim 1, wherein the two pre-shaped flat portions are joined at respective internal flaps which define the stitching line.

9. A shoe formed in accordance with the method of claim 3.

10. A shoe comprising:

a hull shaped base having edges which present a preset curve, said edges being folded outwards and said hull shaped base comprising at least two pre-shaped flat portions joined together along a predetermined stitching line; and, an upper having flaps folded outwardly at an outer periphery thereof, said flaps being joined with the edges of the base.

11. The shoe according to claim 10, wherein each pre-shaped flat portion of the hull shaped base comprises an internal flap, said internal flaps being joined together to define the predetermined stitching line.

12. The shoe according to claim 11, wherein said hull shaped base defines an inner concave surface, said shoe further comprising:

a thermoformable element applied to the inner concave surface of the hull shaped base.

13. The shoe according to claim 10, wherein said hull shaped base defines an inner concave surface, said shoe further comprising:

a thermoformable element applied to the inner concave surface of the hull shaped base.

14. The shoe according to claim 13, wherein said hull shaped base defines an outer convex surface, said shoe further comprising:

a sole element applied at least on a portion of the outer convex surface of the hull shaped base.

15. The shoe according to claim 10, wherein said hull shaped base defines an outer convex surface, said shoe further comprising:

a sole element applied at least on a portion of the outer convex surface of the hull shaped base.

16. The shoe according to claim 12, wherein said hull shaped base defines an outer convex surface, said shoe further comprising:

a sole element applied at least on a portion of the outer convex surface of the hull shaped base.

* * * * *